United States Patent [19]

Yoshida

[11] 4,083,716

[45] Apr. 11, 1978

[54] MAGNESIUM BASE TREATING AGENT OF MOLTEN IRON

[75] Inventor: Hiroshi Yoshida, Kasukabe, Japan

[73] Assignee: Aikoh Co., Ltd., Tokyo, Japan

[21] Appl. No.: 729,085

[22] Filed: Oct. 4, 1976

[30] Foreign Application Priority Data

Nov. 14, 1975 Japan ..... 50-136200

[51] Int. Cl.[2] ..... C22C 33/08; C21C 7/02

[52] U.S. Cl. ..... 75/58; 75/53; 75/130 A; 75/130 AB

[58] Field of Search ..... 75/53, 58, 130 A, 130 AB

[56] References Cited

U.S. PATENT DOCUMENTS

| | | | |
|---|---|---|---|
| 3,656,989 | 4/1972 | Layland | 75/58 |
| 3,953,198 | 4/1976 | Easwaran | 75/53 |
| 3,957,502 | 5/1976 | Cull | 75/58 |

*Primary Examiner*—P. D. Rosenberg
*Attorney, Agent, or Firm*—Fay & Sharpe

[57] ABSTRACT

A magnesium base treating agent of molten iron characterized in that magnesium in the form of particle, powder or piece, having particle size of approximately less than 5 mm, contains one or more of additive components selected from the group of magnesia, zirconia, titania, graphite, coke, charcoal, clay, bentonite, resins, glue, cellulosic type binder, carbohydrate type binder and water-soluble silicic acid binder in 25 to 85% by weight over the whole weight of the moulding, and water of less than 1% by weight, the softening temperature after moulding is in the range from 1000° to 1450° C, and the porosity is between 20 and 50%.

8 Claims, 4 Drawing Figures

MAGNESIUM BASE TREATING AGENT OF MOLTEN IRON

The present invention relates to an improvement in desulfurizing or inoculating agent for molten iron, the main, effective component of which is magnesium.

Conventionally it is known that metallic magnesium has excellent properties as a treating agent for the desulfurization, inoculation or the like of molten iron. On the contrary, however, magnesium floats up at early stage and escapes so as to be consumed for ill effects such as oxidation, by means of the heat of molten iron because of the light weight, low boiling point and rapid reactivity of magnesium when it is used. Magnesium has, on one side, such drawbacks of very bad reaction efficiency because most part of the magnesium does not take part in such principal reactions as desulfurization, inoculation and component addition of molten iron, so that the treating agent of this kind must be used in an extra amount and at a large quantity. To avoid these drawbacks it has conventionally been carried out to insert the treating agent as deep as possible below the melt surface of molten iron by means of an insertion tool or lance or blown into the molten iron, and occasionally to add magnesium in mass by gas-tightly inserting the insertion tool into melt through the cover of sealed pressure resistant ladle. However, in the mere insertion or blowing-in of magnesium, magnesium will instantaneously float up in melt to cause escape and it is difficult to offset said disadvantages sufficiently. Referring to sealed pressure resistant ladle, it is for addition tratment under pressure so that it can prevent magnesium from evaporation but it is in fact limited to a small size one owing to its complicated construction. Sealed pressure resistant ladle of large size requires a vast amount of expense for manufacture and maintenance and lacks an industrial use value.

In order to remove said drawbacks by processing magnesium there is further known a method of controlling reaction rate in such manner that utilizing the porosity of such porous materials as coke, porous refractories and sponge iron, these materials are impregnated with magnesium so that magnesium may not be subject to external heat at one time. Since the pores of the base materials are not of fixed size, and therefore magnesium cannot be uniformly distributed in the base materials, however, reaction may be nonuniform and desired effects may not be obtained. Particularly in the case of treating the melt of high temperature of more than 1400° C, it is hard to make the impregnated magnesium fine because it is unavoidable that the pores of said porous materials becomes larger than a certain degree because the pores were unintentionally produced. Accordingly, permeation of heat is speedy to increase the evaporation rate of magnesium, so that it becomes difficult to control the evaporation rate of magnesium, the added magnesium may escape in a short time, it is dissipated and consumed before the exertion of functions and effects. It is because of this that said materials in themselves are deemed to be unsuitable for high temperature treatment.

This invention is concerned with an improvement of a treating agent with which magnesium is reacted more effectively. The invention is characterized by a magnesium base treating agent of molten iron, which consists of a moulding in which magnesium in the form of particle, powder or piece, having particle size of approximately less than 5mm, contains one or more of additive components selected from the group of magnesia, zirconia, titania, graphite, coke, charcoal, clay, bentonite, resins, glue, cellulosic type binder, carbohydrate type binder and water-soluble silicic acid binder in 25 to 85% by weight over the whole weight of the moulding, and water of less than 1% by weight, and in which the softening temperature after moulding is between 1000° and 1450° C, and the porosity is in the range from 20 to 50%. The invention is also characterized by providing said magnesium base treating agent of molten iron, in which said moulding is the inner layer of the treating agent as necessary, and the outside of the moulding is provided with an outer layer consisting, without containing magnesium or with magnesium content less than in the inner layer, of the same materials as the constitution components of the inner layer in other constituents, said moulding being provided with at least one gas removal orifice of more than 5mm in diameter.

The moulding shape of the agent of treating molten iron accoring to the invention will now be described, by way of example only, with reference to the accompanying drawings, in which.

Figure 1:
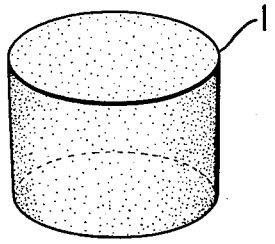
FIG. 1 is a perspective view of a moulding of the present invention, showing a shape of the moulding (1) of the treating agent described in claim 1.
Figure 2:
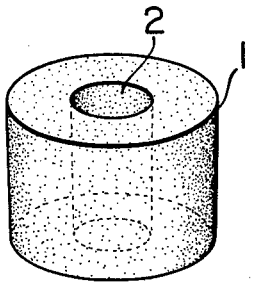
FIG. 2 is a perspective view of the treating agent of molten iron according to the invention, in which agent the moulding (1) shown in FIG. 1 is provided with a gas removal orifice (2)
Figure 3:
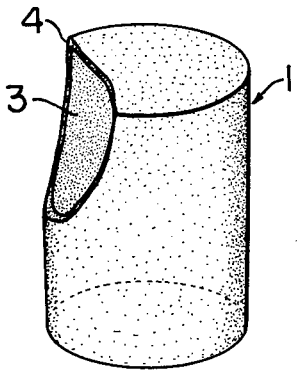
FIG. 3 is a perspective view of the moulding described in claim 2, showing an inner layer (3) and an outer layer (4)
Figure 4:
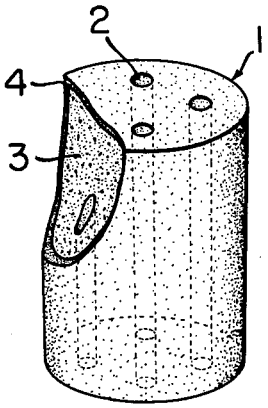
FIG. 4 is a perspective view of the treating agent according to the invention, in which agent the moulding shown in FIG. 3 is provided with a plurality of gas removal orifices (2).

According to the moulding of the present invention, magnesium is contained in uniform dispersion, water content of less than 1% evaporates first when the moulding contacts the melt so as to absorb evaporation heat and avoid instantaneous and sudden rise of temperature, the moulding is prevented from breakage which may be caused by sudden heat rise, additive components are sintered surrounding magnesium by the heat of the molten steel, magnesium is retained as less as possible in direct contact with the melt, magnesium does not melt into the molten steel and becomes gas for evaporation, gradually emanating from the surface of said moulding, and it is possible to freely determine the mixing and size of the moulding which are sufficient for such reactions as bonding Mg in the melt with reacting components, substituting the Mg by the reacting components with the stirring of the melt. To blow out the water vapor and magnesium vapor of said moulding it is required to provide pores to the moulding, and the pores serve, besides emanating vapors, for the prevention of quick blow-out of magnesium by presenting a certain extent of heat insulation to said moulding. Further, the additive components are prepared in such manner that the softening temperature of the molding may be in the range 1000° to 1450° C according to their mixing ratio, so that the moulding may begin softening a little before 1100° C which is the evaporation temperature of magnesium, to give a viscosity i.e. an anti-breaking character to the moulding, and may exhibit a softening state up to 1450° C which falls within the temperature range of treating molten iron. With such actions the moulding can maintain its shape as a carrier of magnesium to the last without collapsing in use.

Accompanying impurities such as $SiO_2$, $Al_2O_3$, CaO, $Fe_2O_3$ and alkali in magnesia, zirconia and titania which are additive components, are unavoidable. These additive components are therefore suitably selected when mixing in kind and quantity in the extent that magnesium is not badly affected. Further, ash content of graphite, coke and charcoal has the same component material as the above, and clay and bentonite have said components as the main components or impurities (alkali in particular) of their own. The same thing can be said with regard to ash content in resins or other organic materials. Since water-soluble silicate binder has a softening temperature of less than 1450° C it will suffice to mix it each occasion according to its components. In addition, the moulding is completed by coating the surface with an outer layer (4) which may not contain magnesium or contain less amount of magnesium to prevent an occurrence of sudden reaction at the start of contact with the melt and by providing gas removal orifices to accelerate evaporation. In this way magnesium reacts at a required rate without effecting quick reaction so that the magnesium reaction is efficient and it will suffice to use less amount of magnesium.

Magnesium which is the main component in the mixture is prepared less than 5mm in its particle size and well distributed in said moulding. The additive components employed in the invention, such as magnesia, zirconia, titania, graphite, coke, and charcoal, which may not react with magnesium or some of them which produce reaction products that generate the same effect even if reaction with magnesium, are mixed in large quantity. However, in small quantity are mixed the additive components having viscosity, such as clay, bentonite, resins (varisous kinds of synthetic resins such as thermoplastic resins or thermo-setting resins, and natural resins such as rosin, shellac, Japanese lacquer, cashew), glues (casein, gluten), cellulosic type binders (methyl cellulose, carboxymethyl cellulose), and carbohydrate type binders (starch, dextrin, mannan, gum arabic, sugar, sorbitol, mannitol). Even these additive components having viscosity may be used in large quantity when the moulding is manufactured by low pressure molding. It is difficult to sufficiently coat the surface of magnesium with less than 25% of the additive components. It exceeds 85% the magnesium quantity becomes too small whereby causing too retarded reaction, prolonging operation time and lowering the temperature of the melt. Thus these two cases are unsuitable. Excess of 1% water content may cause an explosion phenomenon to break the moulding. It might be good enough for water content if dried moulding absorbed the moisture in the atmosphere. As regards the porosity, the porosity of less than 20% make the gas emanation difficult and that of more than 50% lower the breaking resistancy of the moulding, leading to a fear of breakage.

Referring to the composition range of the treating agent of this invention, when said treating agent sinks into molten iron the consumed portions of said moulding will remain as voids in the molten iron as the moulding is consumed starting with the surface because the magnesium particles in the moulding are approximately coupled, and therefore it will not be prevented that the magnesium gas of the inner layer escapes. Moreover, the decomposition gas of the organic substances in the composition stimulates a generation of magnesium vapor in cooperation with water content, contributing to effective functions of magnesium.

The treating agent of the present invention may either be used by being put in the bell-like insertion tool or inserted into the molten steel by being attached to the end of insertion rod.

The treating agent of the invention may be produced by any of the three methods: wet method wherein mixing composition is first mixed, the mixture is slurried and dewatered in a mold whereby drying; semiwet method wherein mixed composition is made wet and moulded under pressure; and dry method wherein a dry mixture is moulded under pressure.

The following Table illustrates some examples in use of the treating agent of the present invention.

Table

| Example No. | | 1 | 2 | 3 | 4 | 5 | | 6 | | 7 | |
|---|---|---|---|---|---|---|---|---|---|---|---|
| Treating agent No. | | 1 | 2 | 3 | 4 | 5 | | 6 | | 7 | |
| Weight and shape of moulding | | 5 Kg mass with gas orifice | 2 Kg mass | 1 Kg mass | 0.5 Kg mass | Kg mass with gas orifice | | 2 Kg mass | | 1 Kg mass | |
| Pores by percent | | 48.5% | 40.4% | 28.8% | 21.5% | 35.3% | | 30.5% | | 25.7% | |
| | | | | | | Inside P | Outside P | Inside P | Outside P | Inside P | Outside P |
| Mixing (% in terms of anhydride) | Magnesium | 17 | 34 | 51 | 68 | 40 | — | 50 | 15 | 60 | 30 |
| | Magnesia | 50 | 40 | 30 | 5 | — | — | — | — | — | — |
| | Zirconia | 5 | — | — | — | — | — | — | — | — | — |
| | Titania | 5 | — | — | — | — | — | — | — | — | — |
| | Graphite | 20 | — | 5 | — | 48 | 88 | 25 | 35 | 36 | 33 |
| | Coke | — | 20 | 5 | 15 | — | — | 19 | 40 | — | 33 |
| | Starch | — | 2 | 2 | 5 | — | — | 3 | 5.5 | 4 | 4 |
| | Phenol resin | 2 | 2 | 3 | 5 | — | — | — | — | — | — |
| | Water glass | — | — | 1 | 2 | 12 | 12 | 3 | 4.5 | — | — |
| | Clay | — | 2 | 1 | — | — | — | — | — | — | — |
| | Bentonite | 1 | — | 2 | — | — | — | — | — | — | — |
| Average Mg content | | 17% | 34% | 51% | 68% | 35% | | 41% | | 50% | |
| Average water content of moulding | | 0.93% | 0.75% | 0.53% | 0.51% | 0.66% | | 0.55% | | 0.25% | |
| Molten iron amount in ladle | | 50 t | 50 t | 5 t | 1.5 t | 50 t | | 5 t | | 5 t | |
| Adding method | | Moulding was inserted into the melt with the use of an insertion tool | | | | | | | | | |
| Additive amount of treating agent | | 20 masses (100 Kg) | 22 masses (44 Kg) | 3 masses (3 Kg) | 7 masses (3.5 Kg) | 10 masses (50 Kg) | | 2 masses (4 Kg) | | 3 masses (3 Kg) | |
| Additive amount of Mg | | 0.34 Kg/t | 0.30 Kg/t | 0.305 Kg/t | 1.58 Kg/t | 0.35 Kg/t | | 0.35 Kg/t | | 0.30 Kg/t | |

Table-continued

| Example No. | 1 | 2 | 3 | 4 | 5 | 6 | 7 |
|---|---|---|---|---|---|---|---|
| Sulfar content in molten iron before treatment | 0.040% | 0.035% | 0.034% | 0.022% | 0.040% | 0.037% | 0.035% |
| Sulfar content in molten iron (S) after treatment | 0.012% | 0.011% | 0.010% | 0.006% | 0.012% | 0.010% | 0.011% |
| Mg content after treatment | — | — | — | 0.061% | — | — | — |
| Mg content reaction ratio | 63% | 61.5% | 60.5% | — | 63% | 26.5% | |

Remarks:
Mg reaction ratio referred to in the Table represents, by percentage, the ratio between the theoretically required amount and the practically used amount of magnesium, where sulfur in the molten iron changes to MgS.

Examples 1, 2, 3, 5, 6 and 7 were carried out for the purpose of desulfurization and Example 4 for the purpose of additing magnesium for the production of spheroidal graphite cast iron.

In comparative examples in which the same amount of molten iron was treated in the same ladle, the Mg reaction ratio was between 10 and 20% in case pure magnesium masses were inserted for treatment to make the sulfur content 0.010 to 0.015%, the ratio was between 40 and 50% in case powder of 50% Mg-Al alloy was blown in, and the ratio was in the range from 50 to 60% when impregnated coke was inserted for treatment. There was no comparative example where the Mg reaction ratio exceeded 60% unlike in the present invention.

In order that the remaining magnesium is more than 0.060% in the molten iron to make ductile cast iron with the addition of magnesium, it was required to add magnesium more than 2.0 Kg/molten iron ton when pure magnesium mass was inserted into molten iron in a 5 ton ladle which is applied with cover and gas-tightly sealed, and the inside of which is retained in a pressure-raised state (3–4 $Kg/Cm^2$).

What I claim is:

1. A composite article having a porosity ranging from about 25 to about 50 percent for treating molten iron comprising a mixture of a plurality of magnesium particles, said particles having a particle size of less than about 5 mm; at least one additive component selected from the group consisting of magnesia, zirconia, titania, graphite, coke and charcoal; and at least one binder therefor selected from the group consisting of clay, bentonite, resins, cellulosic type binder and water-soluble silicic acid.

2. The composite article of claim 1 which further includes up to about 1 weight percent water.

3. The composite article of claim 1 which is characterized by having a softening point ranging from about 1000° to about b 1450° C.

4. The composite article of claim 1 having at least one gas discharge orifice therein.

5. The composite article of claim 4 wherein said gas discharge orifice passes through said article.

6. The composite article of claim 5 wherein said gas discharge orifice has a diameter of less than 5 mm.

7. The composite article of claim 1 having on the outer surface thereof an outer layer comprised of at least one component additive selected from the group consisting of magnesia, zirconia, titania, graphite, coke, charcoal; and a binder therefor.

8. The composite article of claim 7 wherein said outer layer further includes particles of magnesium, said particle having a particle size of less than about 5 mm. and said particles being present in an amount, on a percent basis, which is less than the amount of magnesium particles present in said article without said outer layer.

* * * * *